US009221592B2

(12) United States Patent
Murray

(10) Patent No.: US 9,221,592 B2
(45) Date of Patent: Dec. 29, 2015

(54) FITMENT FOR BEVERAGE POUCH

(71) Applicant: R. Charles Murray, Sarasota, FL (US)

(72) Inventor: R. Charles Murray, Sarasota, FL (US)

(73) Assignee: Pouch Pac Innovations, LLC, Sarasota, FL (US)

( * ) Notice: Subject to any disclaimer, the term of this patent is extended or adjusted under 35 U.S.C. 154(b) by 11 days.

(21) Appl. No.: 14/071,191

(22) Filed: Nov. 4, 2013

(65) Prior Publication Data

US 2014/0124532 A1 May 8, 2014

Related U.S. Application Data

(60) Provisional application No. 61/721,670, filed on Nov. 2, 2012.

(51) Int. Cl.

| | |
|---|---|
| ***B65D 75/58*** | (2006.01) |
| ***B65D 51/16*** | (2006.01) |
| *B65D 35/42* | (2006.01) |
| *B65D 25/48* | (2006.01) |
| *B65D 35/02* | (2006.01) |
| *B65D 35/08* | (2006.01) |
| *B65D 35/12* | (2006.01) |
| *B65D 25/42* | (2006.01) |
| *B65D 47/06* | (2006.01) |

(52) U.S. Cl.

CPC ..... *B65D 75/5883* (2013.01); *B65D 51/1688* (2013.01); *B65D 25/42* (2013.01); *B65D 25/48* (2013.01); *B65D 35/02* (2013.01); *B65D 35/08* (2013.01); *B65D 35/12* (2013.01); *B65D 35/42* (2013.01); *B65D 47/06* (2013.01)

(58) Field of Classification Search

CPC ..... B65D 35/12; B65D 35/02; B65D 35/42; B65D 25/42; B65D 25/48; B65D 47/06; B65D 35/00; B65D 35/08; B65D 75/5883; B65D 51/1688

USPC ..... 222/92, 107, 566–568

See application file for complete search history.

(56) References Cited

U.S. PATENT DOCUMENTS

| | | | | |
|---|---|---|---|---|
| 3,690,524 | A * | 9/1972 | Haberhauer | 222/573 |
| 5,050,722 | A | 9/1991 | Beswick | |
| 5,123,993 | A | 6/1992 | Wiggins | |
| 5,388,705 | A | 2/1995 | Fine et al. | |
| 5,396,981 | A | 3/1995 | Ohtsuji et al. | |
| 5,501,552 | A | 3/1996 | Simkowski | |
| 5,553,698 | A | 9/1996 | Patois et al. | |
| 5,555,700 | A | 9/1996 | Marti | |
| 5,558,200 | A | 9/1996 | Whitby et al. | |
| 5,971,613 | A * | 10/1999 | Bell | 383/107 |
| 6,050,451 | A * | 4/2000 | Hess et al. | 222/92 |

(Continued)

OTHER PUBLICATIONS

The picture shown at "Step 2" shows a 20 oz. soda bottle featuring a threaded top with vertical slits which is being used at least as early as Nov. 1, 2013.

*Primary Examiner* — Frederick C Nicolas

(74) *Attorney, Agent, or Firm* — Dinsmore & Shohl LLP

(57) ABSTRACT

The present invention is a pouch assembly that can be used to store a carbonated beverage such as beer. The pouch assembly includes a pouch and a fitment. The fitment is mounted within an opening of the pouch. A thread is disposed around an outer surface of the first end of the tube spout. The tread disposed around the outer surface of the first end of the tube spout includes one or more slots. The fitment includes at least one alignment tab. The alignment tab extends away from the canoe portion and includes one or more notches.

16 Claims, 4 Drawing Sheets

(56) References Cited

U.S. PATENT DOCUMENTS

| | | | | |
|---|---|---|---|---|
| 6,253,809 | B1 | 7/2001 | Paradies | |
| 6,338,371 | B1 | 1/2002 | Araki et al. | |
| 6,612,466 | B1 * | 9/2003 | Malin | 222/107 |
| 6,860,406 | B2 * | 3/2005 | Kobetsky et al. | 222/92 |
| 7,261,199 | B2 | 8/2007 | Hartness et al. | |
| 7,331,156 | B2 | 2/2008 | Hartness et al. | |
| 7,661,560 | B2 | 2/2010 | Murray | |
| 7,850,044 | B2 * | 12/2010 | Hildebrand et al. | 222/107 |
| 8,366,855 | B2 | 2/2013 | Murray | |
| 8,613,548 | B2 * | 12/2013 | Murray | 383/121 |
| 2007/0047851 | A1 * | 3/2007 | Sato et al. | 383/104 |
| 2007/0110344 | A1 * | 5/2007 | Murray | 383/107 |
| 2007/0217717 | A1 * | 9/2007 | Murray | 383/38 |
| 2008/0073348 | A1 * | 3/2008 | Pritikin et al. | 220/278 |
| 2008/0247684 | A1 * | 10/2008 | Binks et al. | 383/113 |
| 2009/0028470 | A1 * | 1/2009 | Murray | 383/80 |
| 2009/0255626 | A1 * | 10/2009 | Murray | 156/253 |
| 2010/0084436 | A1 * | 4/2010 | Arvizu | 222/525 |
| 2011/0152051 | A1 | 6/2011 | Murray | |
| 2013/0001252 | A1 | 1/2013 | Murray | |
| 2013/0202228 | A1 * | 8/2013 | Murray | 383/42 |
| 2013/0292385 | A1 * | 11/2013 | Murray | 220/521 |

* cited by examiner

FITMENT FOR BEVERAGE POUCH

CROSS-REFERENCE TO RELATED APPLICATIONS

This application claims priority to U.S. Provisional Application Ser. No. 61/721,670 filed Nov. 2, 2012, which is incorporated herein by reference in the entirety.

FIELD OF THE INVENTION

The present invention relates generally to a pouch assembly for packaging a product and more specifically to a flexible pouch having a fitment especially designed for manufacturing and filling purposes.

BACKGROUND OF THE INVENTION

Various types of disposable portable containers are known in the art for storing a fluid or dry product such as a liquid, granular material, powder, or the like. One example of such a container is a flexible pouch. Consumers prefer the convenience of flexible pouches due to their shape, size, and shelf life. Flexible pouches have been used for some time to distribute beverages such as fruit juice and the like. More recently flexible pouches have been utilized for solid food products.

Flexible pouches can be made from a flexible material, preferably a laminate composed of sheets of plastic or aluminum or the like. The flexible pouch often has an opening means at a top portion for access to the contents of the pouch. The opening typically can be a perforated section designed to be able to tear off the top portion of the pouch or it may be a plastic fitment sealed to the flexible pouch that optionally may allow sealing of the pouch after it has been opened.

As the variety of materials to be contained within the pouch increases, in particular to include carbonated liquids, such as beer, a need exists for a specialized fitment top to be part of the pouch allowing increased automation of the manufacture and fill of the pouch with fitment while providing for improved sealing, opening, and resealing means of the pouch.

SUMMARY OF THE INVENTION

The present invention is a pouch assembly that can be used to store a carbonated beverage such as beer. The pouch assembly includes a pouch and a fitment. The fitment is mounted within an opening of the pouch.

The fitment includes a tube spout that can be used to access the inside of the pouch. The fitment has a first end and a second end. Access is provided by a through hole that runs through the tube spout of the fitment from the first end to the second end. A thread is disposed around an outer surface of the first end of the tube spout. A canoe portion is disposed on the second end of the tube spout.

The tread disposed around the outer surface of the first end of the tube spout includes one or more slots. The slot(s) run generally perpendicular to the thread. The slots allow pressure within the pouch to be released as the pouch is opened.

The canoe portion of the fitment is mounted within the opening of the pouch. The fitment includes at least one alignment tab. The alignment tab extends away from the canoe portion and includes one or more notches. The tabs and notches help to secure the fitment to the pouch. The tabs increase the surface area between the pouch material and the fitment, and help to align the direction of the pouch material with the direction of the surface of the fitment. The notches provide a place to receive the pouch material within the fitment.

BRIEF DESCRIPTION OF THE DRAWINGS

Advantages of the present invention will be readily appreciated as the same becomes better understood by reference to the following detail description when considered in conjunction with the accompanying drawings wherein.

DETAILED DESCRIPTION OF THE INVENTION

Figure 1:
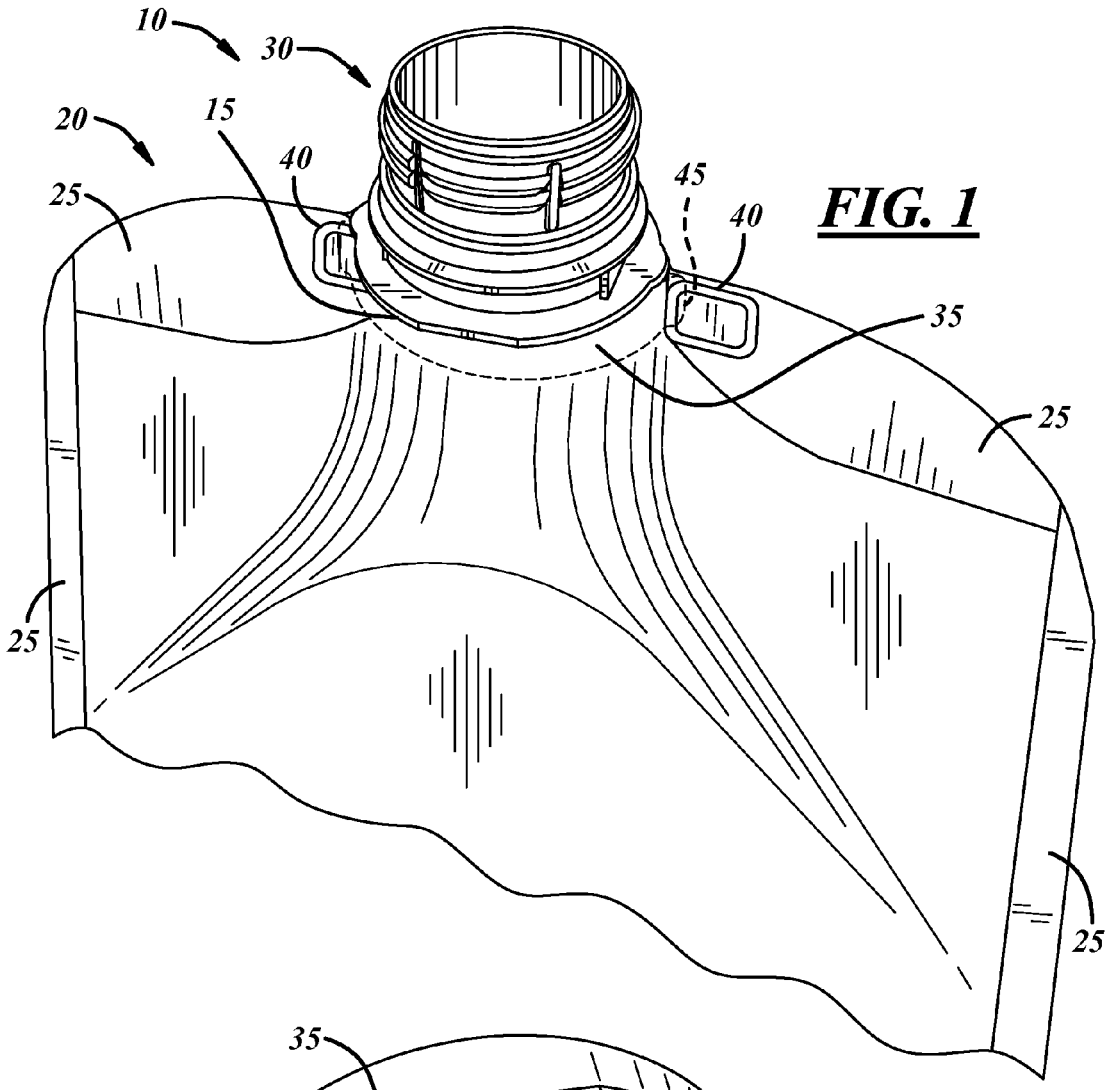
FIG. 1 is a perspective view of the top section of a flexible pouch with a fitment of the present invention.
Figure 2:
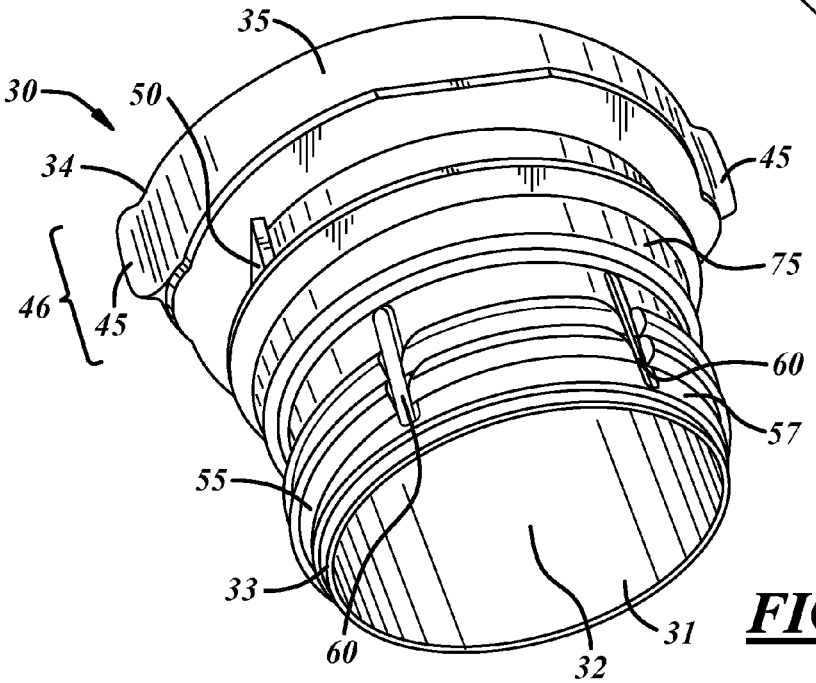
FIG. 2 is a perspective view of the fitment of the present invention.
Figure 3:
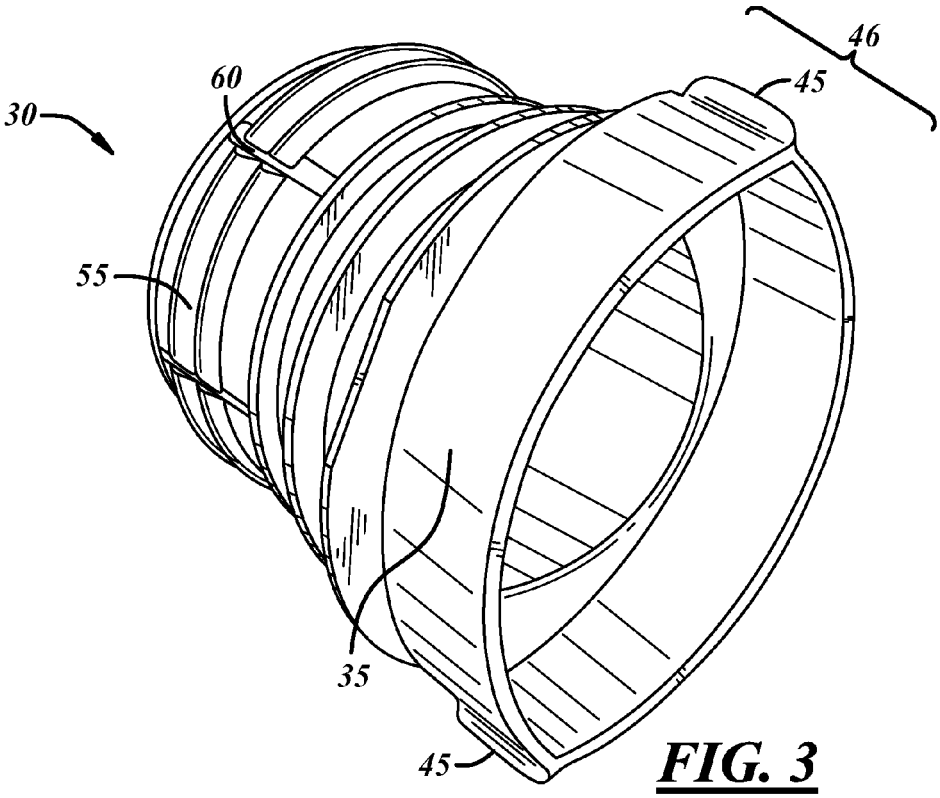
FIG. 3 is an alternate perspective view of the fitment according to the present invention.

As shown in FIG. 1, a pouch assembly 10 of the present invention includes a pouch 20 and a fitment 30. The fitment has a canoe portion 33 mounted within and opening 15 of the pouch 20.

The pouch 20 is made by overlaying two sheets of material and sealing two the material along the edges in a sealed area 25. Alternatively, a singe sheet can be folded to overlap itself, and sealed along the edges, as is known to those skilled in the art. A top of the pouch 20 can be initially left unsealed to provide the opening 15 for the fitment 30. A gusset (not shown) can be inserted along a bottom of the pouch. The flexible pouch 20 can be of various sizes; however the preferred embodiment of the flexible pouch is sized to hold between one and five liters of fluid.

Sealed between the flexible sheets of material that forms the flexible pouch 20 in the opening 15 is the fitment 30. The fitment 30 is sealed to the flexible material along a sealed portion 35. The fitment includes tabs 45 disposed at opposite ends of the fitment 30. The tabs 45 extend into the sealed area 25 of the flexible pouch 20. It is appreciated that the tabs 45 can be of various lengths and shapes as well as various heights as compared to the canoe portion 33.

In addition to the sealed area 25, the tabs 45 can be further secured with a reinforcement seal 40. The shown reinforcement seal 40 is of a rectangular shape; however, other shapes such as bars, circles, and the like could also be used. The sealing process used to seal the sealed area 25 and the reinforcement seal 40 can be a welding or other heat and pressure type seal or any other process of the like known to those skilled in the art.

With reference to FIGS. 2 through 6, the fitment 30 is shown. The fitment 30 includes a tube spout 31. The tube spout 31 has a through hole 32 that extends from a first end 33 of the fitment 30 to a second end 34 of the fitment 30. The through hole 32 provides access to the inside of the pouch 20, for example to fill the pouch with product, or to allow product to be removed from the pouch.

A thread 55 is disposed around an outer surface 57 of the tube spout 31 at the first end 33. The thread 55 has slot(s) 60 running generally perpendicular to the thread 55.

A canoe portion 46 is disposed on the second end 34 of the tube spout 31. The canoe portion 46 is mounted within the opening 15 of the pouch 20, as discussed above. The canoe portion 46 of the preferred embodiment has a symmetrical lens or oval with tapered ends type shape when viewed from an axial direction of the fitment 30.

Figure 8:
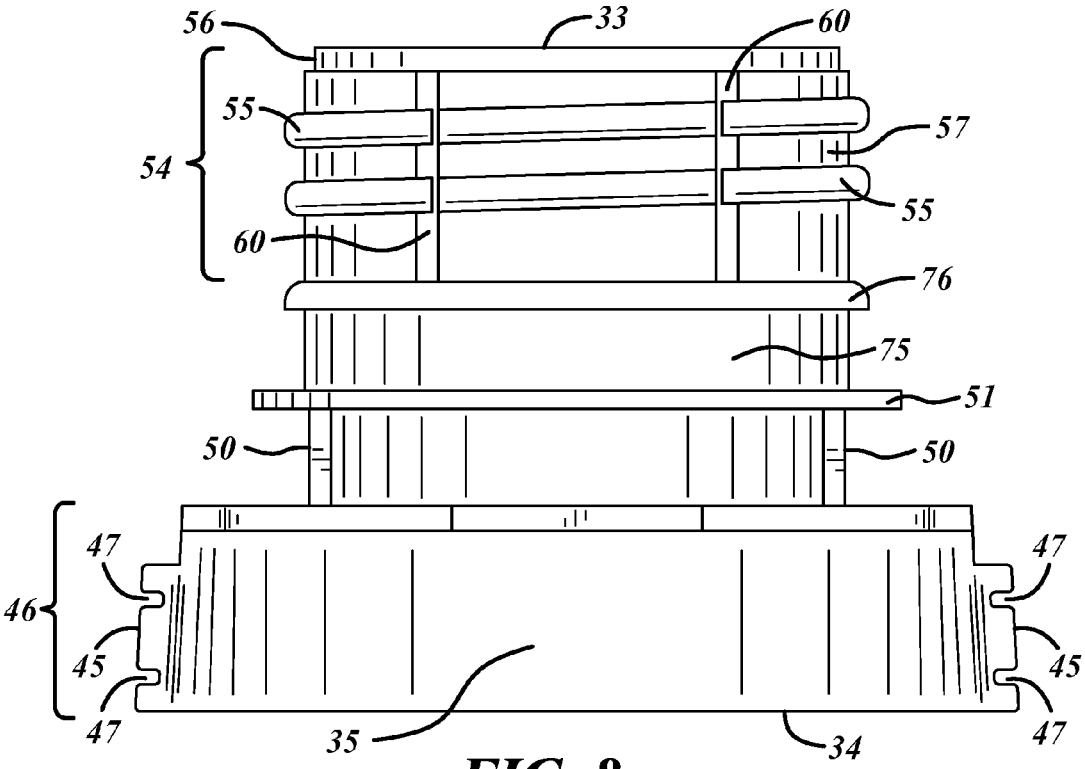
FIG. 8 is a front view of a first alternative embodiment of the fitment.
Figure 9:
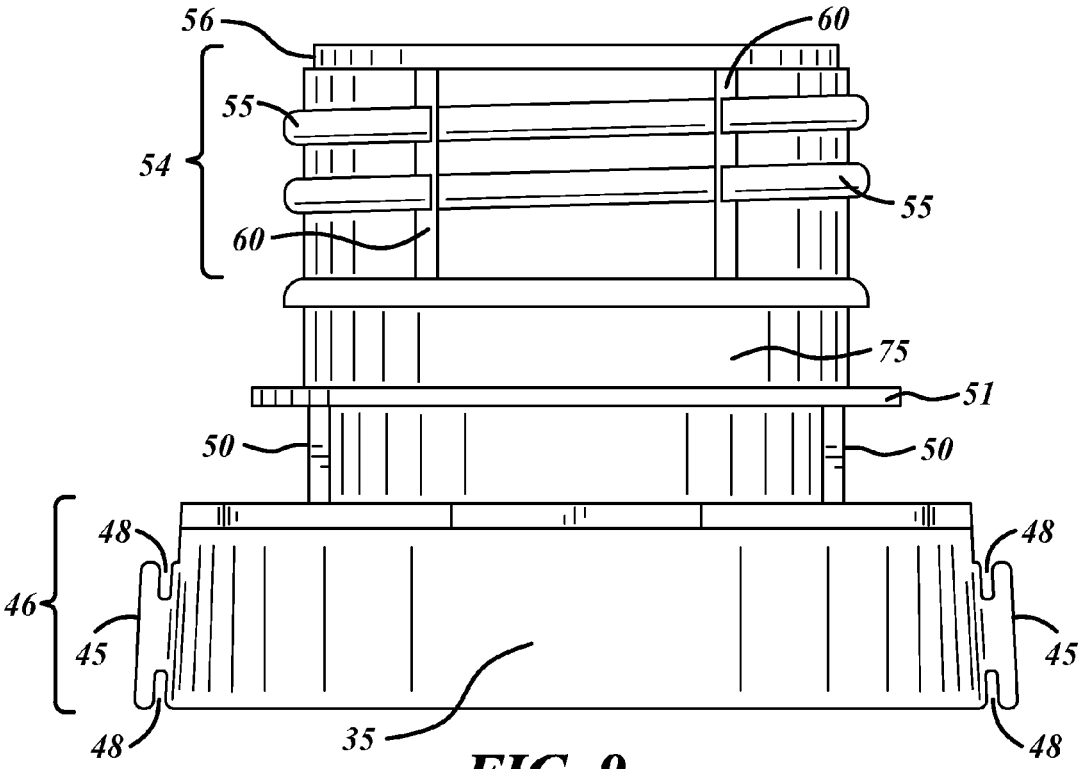
FIG. 9 is a front view of a second alternative embodiment of the fitment.

With reference now to FIG. 8 and FIG. 9, alternate embodiments of the fitment 30 are shown. The alternate embodiments of the fitment 30 include one or more tabs 45. The tabs 45 are located at the second end 34 of the fitment 30, and extend away from canoe portion 46. The tabs 45 include one or more notches 47 48. The notches 47 48 are designed to receive the sheet material forming the pouch 20 to better secure the fitment 30 to the pouch 20. In one embodiment the notches 47 run generally parallel to an axis of the through hole 32 of the tube spout 31. In another embodiment the notches 48 run generally perpendicular to the axis of the through hole 32.

Figure 4:
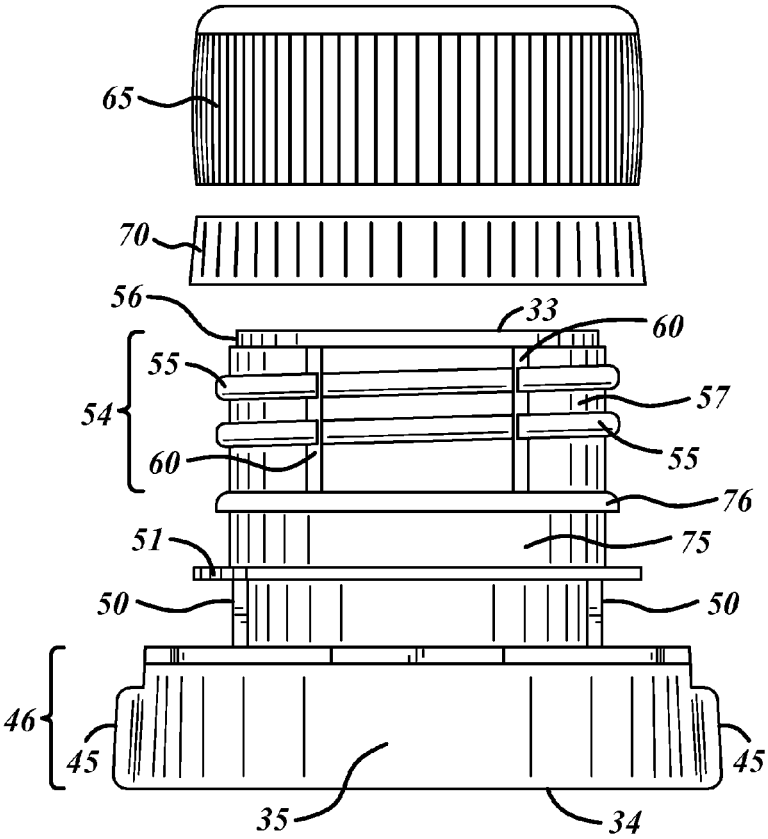
FIG. 4 is an exploded front view of a fitment according to the present invention including a safety seal ring and a cap.
Figure 5:
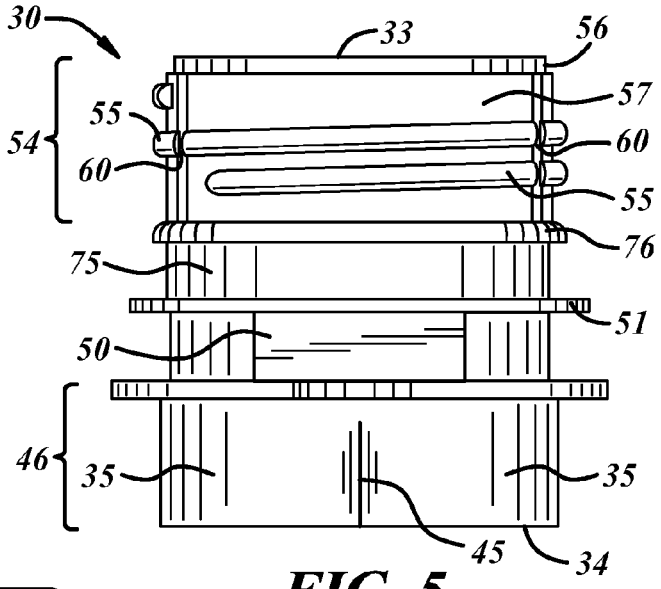
FIG. 5 is a side view of the fitment according to the present invention.
Figure 6:
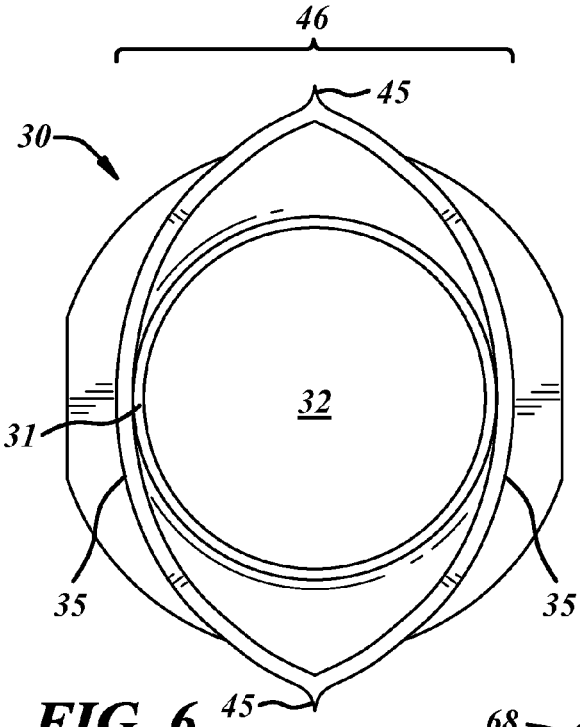
FIG. 6 is a top view of the fitment according to the present invention.
Figure 7:
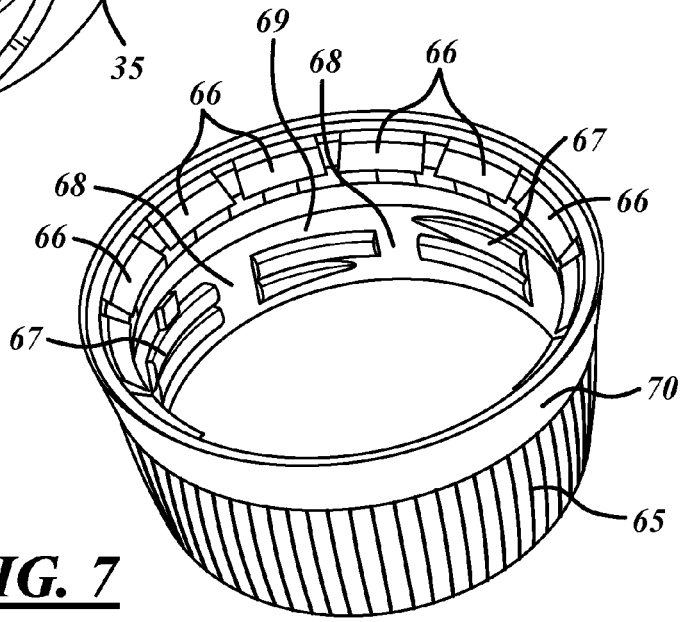
FIG. 7 is a perspective view of a cap for the fitment according to the present invention.

With reference to FIG. 4 and FIG. 7, a cap 65 can be used to close the fitment 30 to maintain product within the pouch 20. The cap 65 has cap threads 67 disposed around an inside surface 69 of the cap 65. The cap threads 67 are designed to interface with the threads 55 of the fitment 30 to secure the cap 65 to the fitment 30. The cap threads 67 include one or more slots 68. The slots 68 in the cap threads 67 are wider than the slots 60 in the threads 55 of the fitment 30. To put the comparative slot size relationship another way, the fitment slot(s) 60 are narrower than the cap thread 67 slots 68.

The narrower fitment thread slots 60 help to provide a smooth threading action by giving more thread surface on the fitment threads 55 to engage with the cap threads 67. The wider cap threaded slots 68 provide a more efficient release of pressure from within the pouch 20 by allowing an increase in amount of rotational distance in which the cap threaded slots 68 and fitment thread slots 60 are aligned, thereby increasing the availability of a pressure release channel or passage while the cap 65 is being removed.

The cap 65 also includes a safety seal ring 70. The safety seal ring 70 has a plurality of safety tabs 66 that extend inwardly from the safety seal ring 70. The safety tabs 66 are received by a safety seal receiving portion 75, as shown in FIGS. 4, 5, 8 and 9.

The safety seal ring 70 when initially installed is bonded to the cap 65, and slides down over the threaded portion 54 to be received and secured in the safety seal receiving portion 75. To provide the bonding, the cap 65 and safety seal ring 70 can being integrally formed by methods known to those skilled in the art, injection molding for example.

The safety seal ring 70 is secured within the safety seal receiving portion 75 by an outwardly extending lip 76 disposed between the safety seal receiving portion 75 and the thread 55. The safety tabs 66 traverses the extending lip 76 when the cap 65 and safety seal ring 70 are installed. However the safety tabs 66 are unable to travel back across the extending lip 76 when the cap 65 is removed. As a result, when the cap 65 is removed, the safety seal ring 70 is detached from the cap 65, and the safety seal ring 70 remains within the safety seal receiving portion 75.

Lastly, the fitment 30 includes a pair of guide surfaces 50. The guide surfaces 50 are disposed on opposite sides of the tube spout 31 between the thread 55 and the canoe portion 33, and run generally parallel to each other. The guide surfaces 50 are located below a support ring 51 that extends outwardly from the tube spout 31. The support ring 51 can be used to support the fitment 30 and/or pouch assembly 10 as it moves through the manufacturing and fill process. The support ring 51 can ride on rails or other support mechanisms (not shown). The guide surfaces 50 provide a way of orientating the fitment 30 relative to the rails or other mechanism.

The guide surfaces 50 of the preferred embodiment are flat and generally rectangular in shape. It is appreciated that the guide surfaces 50 can be of different heights and widths than those shown in the preferred embodiment so long as they are parallel and disposed at opposite sides of the fitment 30 maintaining proper alignment of the fitment 30 and flexible pouch 20 as it travels through the manufacturing process, as discussed further infra.

The process utilizing the guide surfaces 50 to install the fitment 30 into the flexible pouch 20 and fill the pouch 20 is as follows. The pouch 20 having an opening 15 is provided using manufacturing methods know to those skilled in the art. This manufacturing process can be for example, providing one or more sheets of an appropriate flexible material known to those skilled in art, and then forming and sealing the material in a pouch form. Also provide is the fitment 30, which can be made of injection molded plastic, or other methods and materials known to those skilled in the art. The pouch 20 can then be mated with the fitment 30. When the pouch 20 is mated to the fitment 30, it is important the two components be properly aligned for a proper seal to be achieved.

The pouch 20 can be manipulated with a pinch type grabbing mechanism along an edge of the pouch 20, providing a set orientation of the pouch 20. The fitment 30 is manipulated with the guide surfaces 50, for example by traveling along a pair of guide rails, thereby providing a set orientation of the fitment 30. The fitment 30 and pouch 20 having proper orientations can then be mated and sealed. The guide rails that are used to align the fitment 30 along the guide surfaces 50 are then used to assist it transferring the pouch 20 sealed to the fitment 30 to a filling station. The filling station fills the pouch 20 through the fitment 30.

After the pouch 20 has been formed, sealed to the fitment 30, and filled as discussed above, the cap 30 with the safety seal ring 70 is installed. To install the cap 65 with the safety seal ring 70, the cap 65 and ring 70 are first pressed down onto the fitment 20. The fitment 30 has a top portion 56 which has a slightly smaller outer diameter than the rest of the fitment 30. The smaller diameter of the top portion 56 helps to align the cap 65 and ring 70 to the fitment 30. In addition, the top portion 56 provides an initial flexing of the safety tabs 66 which are pressed over the top portion 56 and the threaded portion 54 in the first step of the cap 65 and ring 70 installation.

After the cap 65 and ring 70 is pressed onto the fitment, the cap 65 and ring 70 are rotated relative to the fitment 30 to engage the cap threads 67 with the fitment threads 55. As the cap 65 is threaded onto the fitment 30, the safety tabs 66 are urged down to the safety seal receiving portion 75. The safety tabs 66 are then secured in the safety seal receiving portion 75, thereby securing the ring 70 and requiring the ring 70 to be separated from the cap 65 when the cap 65 is unthreaded from the fitment 30.

It is appreciated, of course, that many modifications and variations of the present invention are possible in light of the above teachings and may be practiced other than as specifically described. It is therefore to be understood that the terminology used is intended to be in the nature of words of description rather than limitation. The invention has been described thus in an illustrative manner.

The invention claimed is:

1. A pouch assembly comprising:

a pouch having an opening;

a fitment mounted within the opening;

the fitment including a tube spout having an outer surface, a first end and a second end, a thread disposed on the outer surface of the first end of the tube spout, and a canoe portion disposed on the second end of the tube spout and mounted within the opening of the pouch;

the tube spout including a though hole extending between the first end and the second end;

the thread including one or more slots, the one or more slots run generally perpendicular to the thread; and a pair of generally parallel guide surfaces being disposed on opposite sides of the tube spout located between the thread of the fitment and the canoe portion.

2. The pouch assembly of claim 1 further comprising:

the pouch being formed of sheet material; and the canoe including at least one tab, the tab extending away from the canoe portion, the tab including one or more notches, the notches adapted to receive the sheet material of the pouch thereby providing a secure attachment of the canoe to the pouch.

3. The pouch assembly of claim 1 further comprising:

a cap having cap threads;

the cap threads being designed to interface with the thread of the fitment thread, and including one or more slots.

4. The pouch assembly of claim 3 wherein the slots in the cap thread are wider than the slots in the thread of the fitment.

5. The pouch assembly of claim 3 further comprising:

a safety seal ring disposed mounted to the cap; and the fitment including a safety seal receiving portion located between the thread and the canoe portion of the fitment.

6. A pouch assembly comprising:

a pouch having an opening, the pouch formed from a sheet material;

a fitment mounted within the opening;

the fitment including a tube spout having a first end and a second end, a canoe portion disposed on the second end of the tube spout mounted within the opening of the pouch;

the tube spout including a though hole extending from the first end to the second end; and the canoe including at least one tab, the tab extending away from the canoe portion, the tab including one or more notches, the notches adapted to receive the sheet material of the pouch thereby providing a secure attachment of the canoe to the pouch.

7. The pouch assembly of claim 6 further comprising:

the tube spout having an outer surface;

a thread disposed on the outer surface of the first end of the tube spout, the thread including one or more slots.

8. The pouch assembly of claim 7 further comprising:

a cap having cap threads;

the cap threads being designed to interface with the thread of the fitment thread, and including one or more slots.

9. The pouch assembly of claim 8 wherein the slots in the cap thread are wider than the slots in the thread of the fitment.

10. The pouch assembly of claim 8 further comprising:

a safety seal ring disposed mounted to the cap; and the fitment including a safety seal receiving portion located between the thread and the canoe portion of the fitment.

11. The pouch assembly of claim 8 further comprising:

a pair of generally parallel guide surfaces being disposed on opposite sides of the tube spout located between the thread of the fitment and the canoe portion.

12. A fitment for a pouch formed of sheet material comprising:

a tube spout having a first end and a second end;

a canoe portion disposed on the second end of the tube spout;

the tube spout including a though hole from the first end to the second end; and the canoe including at least one tab, the tab extending away from the canoe portion, the tab including one or more notches, the notches adapted to receive the sheet material of the pouch thereby providing a secure attachment of the canoe to the pouch.

13. The fitment of claim 12 further comprising:

the tube spout having an outer surface;

a thread disposed on the outer surface of the first end of the tube spout, the thread including one or more slots.

14. The fitment of claim 13 further comprising:

a cap having cap threads;

the cap threads being designed to interface with the thread of the fitment thread, and including one or more slots.

15. The fitment of claim 14 wherein the slots in the cap thread are wider than the slots in the thread of the fitment.

16. The fitment of claim 14 further comprising:

a safety seal ring disposed mounted to the cap; and the fitment including a safety seal receiving portion located between the thread and the canoe portion of the fitment.

* * * * *